United States Patent [19]

Skala

[11] 4,332,290

[45] Jun. 1, 1982

[54] APPARATUS FOR RAPID HEAT TRANSFER AND EFFICIENT HEAT STORAGE

[76] Inventor: Stephen F. Skala, 3839 S. Wenonah Ave., Berwyn, Ill. 60402

[21] Appl. No.: 157,480

[22] Filed: Jun. 9, 1980

Related U.S. Application Data

[63] Continuation-in-part of Ser. No. 756,392, Jan. 3, 1977, Pat. No. 4,164,253, which is a continuation-in-part of Ser. No. 30,997, Apr. 18, 1979, abandoned.

[51] Int. Cl.[3] ..... F24D 11/00; F28D 17/00

[52] U.S. Cl. ..... 165/10; 165/104.11; 165/104.18; 237/56; 219/325; 219/365

[58] Field of Search ..... 165/104 S, 104.18, 10, 165/104.11; 219/378, 365, 325, 326, 341; 126/400

[56] References Cited

U.S. PATENT DOCUMENTS

| | | | |
|---|---|---|---|
| 3,780,356 | 12/1973 | Laing | 165/104.17 X |
| 4,170,261 | 10/1979 | Laing et al. | 165/104.17 X |
| 4,219,076 | 8/1980 | Robinson, Jr. | 165/104 S |

*Primary Examiner*—Albert W. Davis
*Attorney, Agent, or Firm*—Stephen F. Skala

[57] ABSTRACT

Heating of intermittent users, such as domestic appliances, may require a rapid transfer of heat during an operating period. But hot reservoirs based on transitions between liquid and crystalline phases are least effective during rapid discharge since the crystalline latent heat storing material forming on encapsulating heat transfer surfaces increases thermal impedence. Various means for shortening thermal paths through the crystalline material, such as penetrating conductors, undesirably decrease thermal energy density.

In order to provide both rapid heat transfer capability and a large thermal energy density, the invention uses prolonged idle periods between the operating periods for passive recharging within a hot reservoir of a first latent heat storing material by a second latent heat storing material which has a higher melting point so that the first latent heat storing material melts while the second crystallizes as the hot reservoir approaches a uniform equilibrium temperature. The first latent heat storing material is encapsulated in assemblies having short thermal paths for rapid heat transfer and has sufficient thermal capacity for one of the operating periods. The second latent heat storing material is encapsulated in assemblies having a large thermal energy density and has a thermal capacity which is sufficient to recharge the first for a plurality of the idle periods. Accordingly, the hot reservoir includes a first latent heat storing material assembly for rapid discharge and a second latent heat storing material for a large energy density and passive recharging of the first latent heat storing material.

2 Claims, 3 Drawing Figures

APPARATUS FOR RAPID HEAT TRANSFER AND EFFICIENT HEAT STORAGE

BACKGROUND OF THE INVENTION

The present application is a continuation-in-part of application Ser. No. 756,392 filed Jan. 3, 1977 and now U.S. Pat. No. 4,164,253 which is a continuation-in-part of Ser. No. 30,997 filed Apr. 18, 1979 and now abandoned.

This invention relates to apparatus for storing heat in latent heat storing materials.

The invention has particular application as a hot reservoir in a system of domestic appliances wherein heat is exchanged by a liquid thermal exchange fluid between the hot reservoir and the appliances. A typical domestic cooking appliance is heated rapidly to an operating temperature which is sustained for an operating period. Thereafter, the appliance has a prolonged idle period at ambient temperature until another operating period of food preparation. More generally, the invention provides a heat source of low thermal impedance for intermittent users having a plurality of operating periods separated by idle periods of substantial duration.

A hot reservoir may include an encapsulated latent heat storing material in an insulated vessel for heat transfer to the thermal exchange fluid. The latent heat storing material is selected to have a high heat of transition between liquid and crystalline phases at a temperature sufficient for effective heat transfer at the maximum operating temperature of the intermittent user. During a charging period at off-peak hours and at moderate power levels, transfer of heat into the latent heat storing material is highly effective since melting first occurs at the encapsulating heat transfer surface and then progresses inward aided by convection of the melt. But, during a user operating period when a high discharge rate is needed, crystallization of the latent heat storing material on the encapsulating surface impedes heat transfer. This thermal impedence can be reduced by shortening thermal paths through the crystalline latent heat storing material, but the resulting structures have a large ratio of surface to volume which undesirably diminishes thermal energy density. Accordingly, conventional hot reservoirs either have an excessively large volume and consequent heat loss or they have an inadequate rate of heat transfer to the intermittent users.

It is a general object of the invention to provide an improved apparatus for storing heat in and releasing the heat from latent heat storing materials.

It is another object to provide such apparatus having both a large heat storage density and rapid heat transfer capability.

SUMMARY

These and other objects and advantages which will become apparent are attained by the invention wherein a first latent heat storing material having short thermal paths therethrough is recharged by a second latent heat storing material which has a higher phase transition temperature. The first latent heat storing material provides rapid heat transfer during an operating period and the second provides a high thermal energy density and capacity for a plurality of recharging phases during idle periods.

Basic apparatus of the invention comprises the first latent heat storing material structured for short thermal paths, the second latent heat storing material having a higher phase transition temperature, and means to exchange heat therebetween. The first latent heat storing material includes a crystalline phase and may have transitions between different crystalline phases or between a liquid and crystalline phase. The short thermal paths include conductive penetrations and a thin structure such as a layer of first latent heat storing material which surrounds a body of the second latent heat storing material. The heat exchange relationship may comprise forced convection of a heat transfer fluid but preferably is passive heat transfer by conduction or natural convection within a common insulated vessel. Within the common insulated vessel and and during an idle period, heat loss is negligible and temperature equilibrates at the phase transition temperature of the second latent heat storing material which is selected to be sufficiently above the phase transition temperature of the first latent heat storing material to assure an adequate rate of heat transfer for recharging between operating periods.

In a representative system, a liquid thermal exchange fluid transfers heat from the hot reservoir to intermittent users such as domestic appliances. The hot reservoir comprises the first and second latent heat storing materials in an insulated vessel. The first latent heat storing material has a phase transition temperature which is sufficiently above the maximum operating temperature of the users to assure rapid heat transfer thereto through through the thermal exchange fluid. The low thermal impedence of the first latent heat storing material and the high energy density of the second latent heat storing material thus provide in a compact hot reservoir effective heat transfer for intermittent users.

DESCRIPTION OF THE DRAWINGS

FIG. 1 shows a fluid heat transfer system having a large thermal capacity for intermittent users which users are characterized by a plurality of operating periods at high operating temperatures separated by idle periods at substantially lower temperatures.

Figure 1:
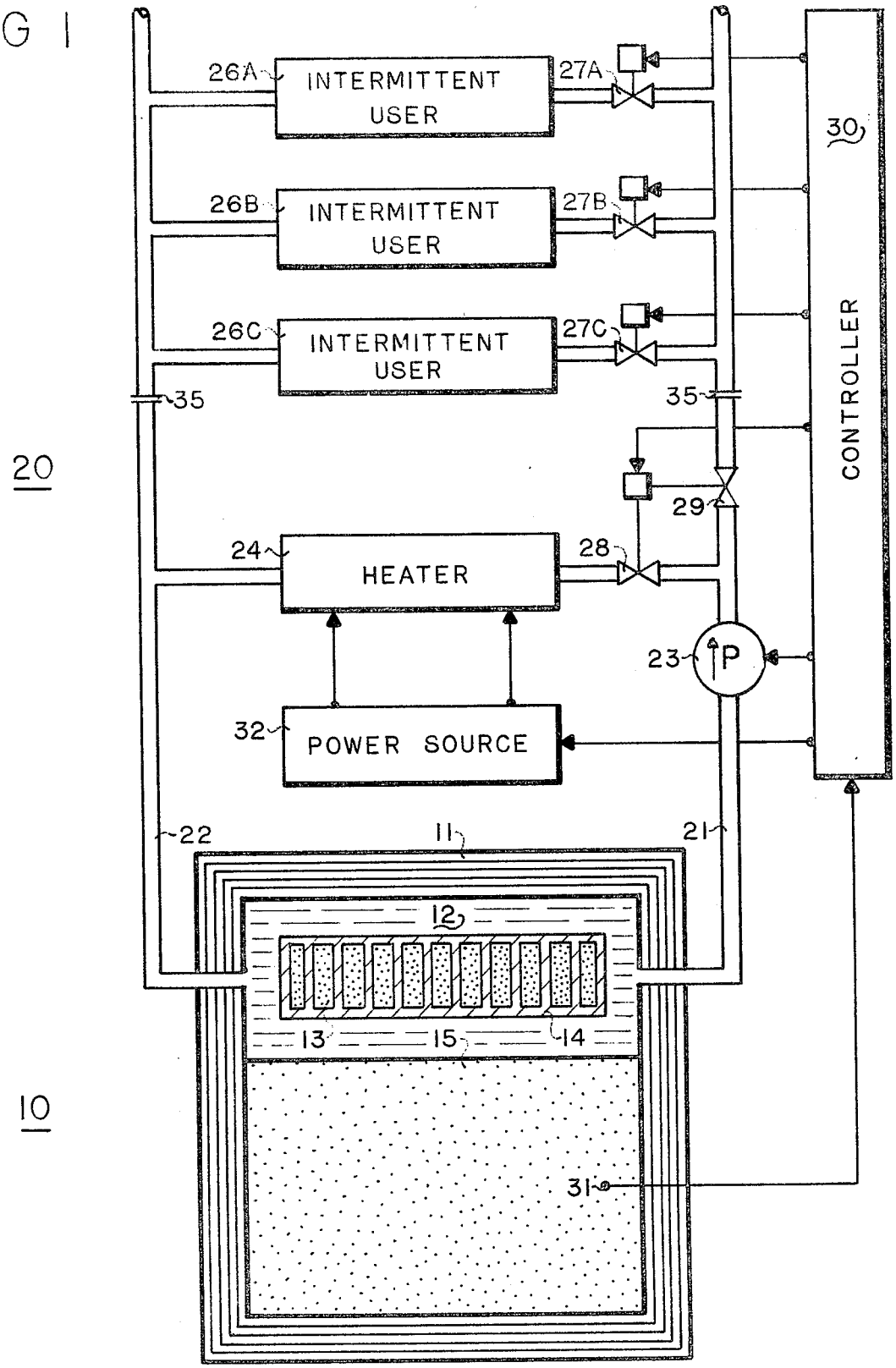
FIG. 1 is a diagrammatic representation of the system of the invention showing a hot reservoir with the two types of latent heat storing materials and heat transfer means for the intermittent users.

A hot reservoir assembly 10 comprises an insulated vessel 11 containing a heat transfer fluid 12 and two types of latent heat storing materials which differ in phase transition temperature and in structure to combine rapid heat transfer for user peak demand with a large thermal storage density for reduced heat loss through the insulated vessel.

A first latent heat storing material 13 has a phase transition temperature sufficiently above operating temperatures of users to allow a satisfactory rate of heat transfer through thermal impedences therebetween. It is encapsulated in a thermally conductive enclosure 14 which provides short thermal paths from the first latent heat storing material to the heat transfer fluid 12. Thermal capacity of the first latent heat storing material is sufficient to heat the users to their setpoint temperatures during an operating period but reserve capacity is not large since the short thermal paths which provide rapid heat transfer capability also result in reduced thermal storage density.

A second latent heat storing material 15 is in a heat exchange relationship with the first latent heat storing material 13 and has a sufficiently higher phase transition temperature to transfer heat from the second latent heat storing material at a sufficient rate to recharge the first latent heat storing material during an idle period. It has sufficient thermal capacity for a plurality of recharging periods and is structured for a large thermal storage density. The large thermal storage density of the second latent heat storing material is attained by such means as substantially filling an available portion of the hot reservoir and avoiding penetrations of thermal conductors or of heat transfer fluid to provide a large ratio of volume to surface.

A fluid circuit 20 in which the heat transfer fluid 12 circulates comprises the hot reservoir assembly 10, a supply conduit 21, a return conduit 22, a pump 23 to develop a pressure therebetween, a heater loop comprising heater 24 for charging the latent heat storing materials, a user loop comprising intermittent users 26A, 26B, and 26C, and regulator valves 27A, 27B, and 27C. A pair of selector valves 28 and 29 function to select either the heater loop or the user loop for flow of the heat transfer fluid. A controller 30 operates in response to predetermined programs, manual inputs, and internal timers, none of which are shown, to regulate the fluid heat transfer system.

A hot reservoir charging cycle is enabled by the internal timer in the controller during off-peak hours. In this period, the controller responds to temperature sensor 31 to operate power source 32 when the hot reservoir is not sufficiently above the second latent heat storing material's phase transition temperature to assure complete charging. At the same time, the controller provides power to open selector valve 28, to close selector valve 29, and to operate pump 23 which circulates heat transfer fluid through the heater loop and through the hot reservoir. The second latent heat storing material remains substantially at its phase transition temperature until charging is completed after which its temperature rises to attain a predetermined level at the temperature sensor 31 which causes the controller to turn off the power source.

Heat is transferred from the hot reservoir to the intermittent users in response to the controller which provides power to operate pump 23, to close selector valve 28 and open selector valve 29, and to open at least one of the regulator valves 27A, 27B, and 27C. The heat transfer fluid then circulates in a path which includes the hot reservoir and the intermittent users. The circulating heat transfer fluid is heated rapidly by the first latent heat storing material 13 which normally has sufficient thermal capacity for an operating period of the users. During an idle period when the users are not operating and the heat transfer fluid is not circulating, temperature in the hot reservoir equilibrates at the phase transition temperature of the second latent heat storing material. Heat released by discharge of the second latent heat storing material flows to recharge the first latent heat storing material, which has a lower phase transition temperature, until the recharging is complete.

Figure 2:
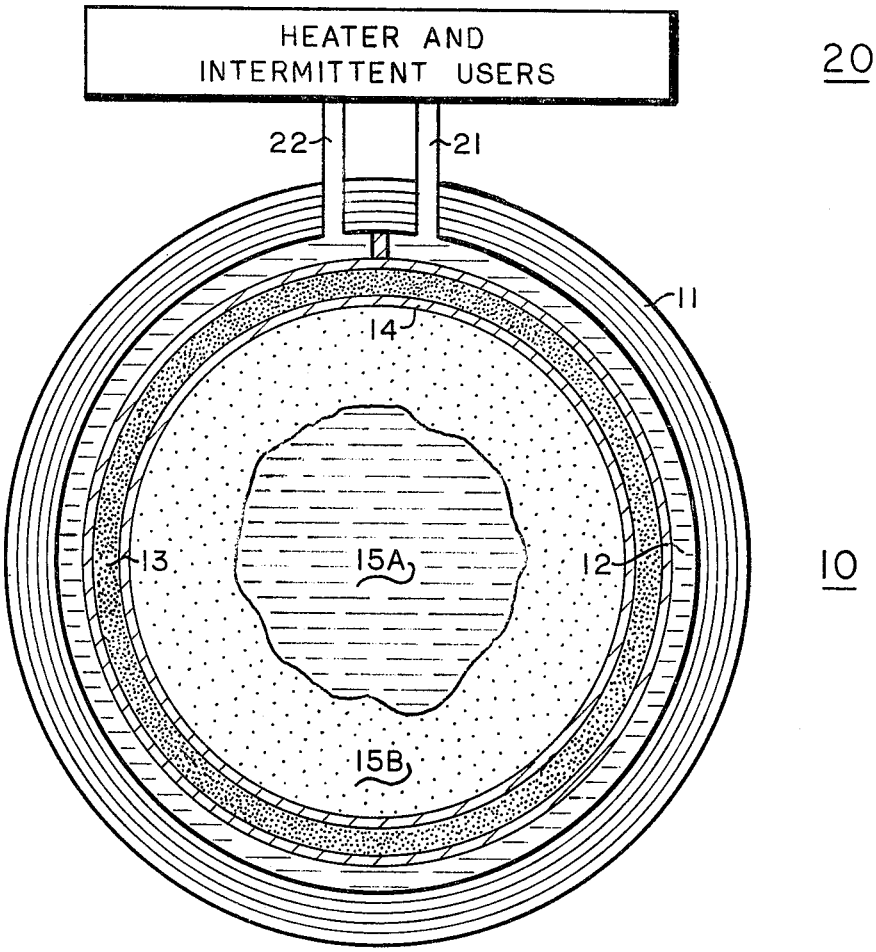
FIG. 2 is a schematic drawing partly in cross-section of a hot reservoir having the second heat storing material in a spherical form for maximum heat storage density and the first latent heat storing material as a surrounding shell for short thermal paths to a heat transfer fluid.

FIG. 2 shows a preferred configuration of latent heat storing materials wherein the first latent heat storing material 13 is an outer layer adjacent to a body of second latent heat storing material 15A and 15B. The outer layer provides short thermal paths to heat transfer fluid 12 for effective heat transfer. The inner body of second latent heat storing material has a large ratio of volume to surface for large heat storage density which a spherical form maximizes. The first and second latent heat storing materials are adjacent, except for a thermally conductive encapsulating layer 14, for effective heat transfer from the second to the first latent heat storing material.

The hot reservoir 10 of FIG. 2 shows the preferred embodiment comprising latent heat storing materials having transitions between liquid and crystalline phases and a liquid phase heat transfer fluid such as alkali metal for use at the high temperatures of an appliance system. The hot reservoir 10 is shown at the end of an operating period which discharged the first latent heat storing material. With entry into an idle period, flow of the heat transfer fluid 12 stops and temperature throughout the hot reservoir tends to equilibrate at the phase transition temperature of the second latent heat storing material. Since the first latent heat storing material has a lower phase transition temperature, it recharges into a liquid phase while the second latent heat storing material discharges with an increase of the crystalline phase 15B. The thermal capacity of the second latent heat storing material is designed to be sufficient for recharging of the first latent heat storing material during the idle periods between off-peak hours. The difference of phase transition temperatures between the first and the second latent heat storing material is selected to provide adequate heat transfer for recharging during the normal duration of an idle period.

As the system enters an operating period, heat transfer fluid entering the hot reservoir is heated rapidly by the heat which is released as the first latent heat storing material crystallizes on the outer encapsulating layer. Thermal impedence increases with the crystallization but still remains small due to the short thermal paths into the layer of first latent heat storing material. At the end of a normal operating period, most of the first latent heat storing material is in a discharged crystalline phase. As the operating period ends, the recharging of the first latent heat storing material by discharge of the second is repeated during an idle period as described previously.

The hot reservoir 10 is recharged during off-peak hours. The heat transfer fluid 12 circulates through the heater and the hot reservoir at a temperature above the phase transition temperature of the second latent heat storing material. Recharging can proceed rapidly as the melting latent heat storing materials transfer heat inward by convection.

A preferred first latent heat storing material is sodium hydroxide having a latent heat of fusion of 40 cal/gm at 318° C. A preferred second latent heat storing material is sodium nitrate having a latent heat of fusion of 45 cal/gm at 333° C. Both phase transition temperatures can be lowered by partial substitution of potassium for sodium.

Figure 3:
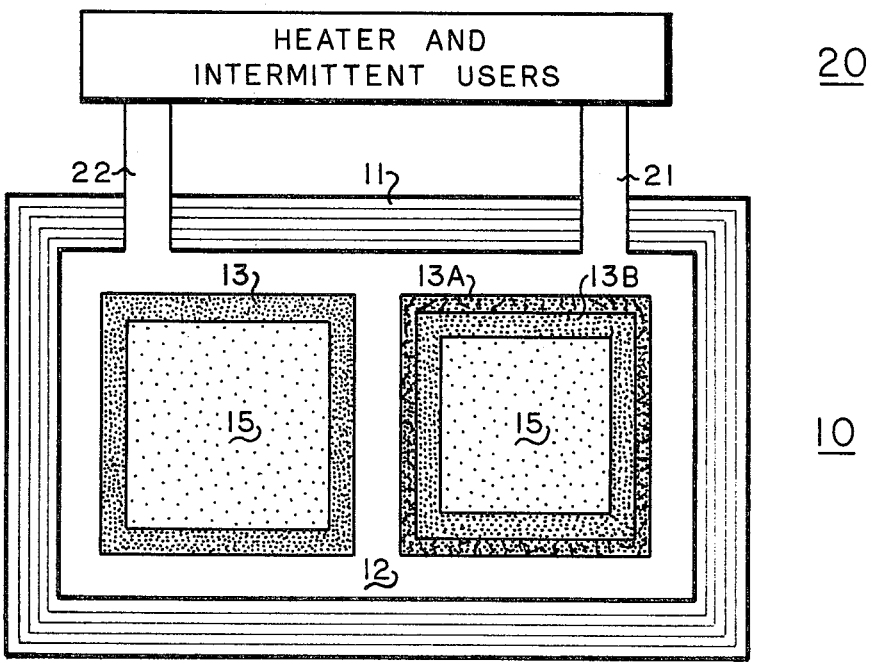
FIG. 3 is a schematic drawing partly in cross section showing an alternative hot reservoir according to the invention.

FIG. 3 shows alternative embodiments of the invention with particular reference to an air heater which stores and releases latent heat as a transition between crystalline phases. The air heater includes features of a space heating furnace having latent heat stored in blocks of sulfate salts which was disclosed by M. Telkes in U.S. Pat. No. 2,808,494. Sodium sulfate has a latent heat of transition between hexagonal and rhombic crystalline forms of 71 cal/gm at 233° C. which temperature can be reduced to 182° C. by a partial substitution of potassium for the sodium. The blocks are fabricated by compression of a moistened salt in a mold cavity.

In FIG. 3, an air heater comprises a first latent heat storing material 13 such as the sodium-potassium sulfate having a phase transition temperature of 182° C. surrounding a second latent heat storing material 15 such as the sodium sulfate having a phase transition temperature of 233° C. Alternatively, the first latent heat storing material comprises a plurality of layers such as 13A having a phase transition temperatures of 182° C. and incorporating steel wool to improve thermal conductivity surrounding another layer 13B having a phase transition temperature above that of 13A but below that of the second latent heat storing material 15. Since the phase transition temperature of 13B is lower than that of 15, it is recharged from 15 during idle periods when the temperature within insulated vessel 11 approaches a constant level at the phase transition temperature of 15. The recharge layer 13B then provides reserve thermal capacity for the adjacent layer 13A through short thermal paths. As a further alternative not shown additional layers, or even a continuous gradient, of progressively increasing phase transition temperatures into a body of solid latent heat storing material comprise a structure wherein latent heat tends to be stored in the outermost portions thereby providing minimal thermal paths for heat transfer to heat transfer fluid 12 for a more effective peak thermal capacity.

Heat transfer to intermittent users and recharging of the latent heat storing materials correspond to the description of FIG. 1. During off-peak hours, a gaseous heat transfer fluid 12 such as air heated above the phase transition temperature of the second latent heat storing material is forced to flow through ducts 21 and 22 and through the insulated vessel 11 to recharge the latent heat storing materials in in response to a blower and dampers which are controlled by the controller in heater and intermittent user assembly 20. During an operating period, the air is heated by the first latent heat storing materials 13 and 13A. During an idle period, heat from the second latent heat storing material recharges the first latent heat storing material.

A characteristic of the first latent heat storing material is that it has short thermal paths to the heat transfer fluid. Such short thermal paths occur in thin shells, small spheres, thin cylinders, volumes penetrated by the heat transfer fluid, or other geometrical forms having a large ratio of surface to volume. A thermal path through an intermediate material of high thermal conductivity to the heat transfer fluid normally does not have a large thermal impedence so that short thermal paths through a body of first latent heat storing material and through a thermal conductor are equivalent to short thermal paths directly to the heat transfer fluid. Such thermal conductors include metal secondary surfaces having the form of fins, rods, needles, and fibers penetrating into the body of the first latent heat storing material.

A hot reservoir assembly according to the invention is disclosed with reference to FIG. 2 of the cited parent application now U.S. Pat. No. 4,164,253. A first latent heat storing material in the form of thin cylinders to provide a short thermal path and a second latent heat storing material in the form of larger cylinders to provide a substantially larger heat capacity and heat storage density are immersed in a liquid alkali metal heat transfer fluid. The latent heat storing material and the heat transfer fluid are enclosed within a vessel which is insulated by an evacuated multilayer type insulation. In an evacuated system comprising a vacuum in a double walled vessel, heat loss by convection is virtually eliminated and heat loss by conduction is limited to conduit penetrations and other structural members which span the vessel walls. The multilayers in the evacuated space comprise a plurality of metalized fabric or similar sheets. Impedence to thermal radiation is improved over Dewar vessels by increased radiation reflection, scattering, and absorbtion.

What I claim is:

1. Apparatus for storing and releasing heat, comprising a plurality greater than two of nested layers of latent heat storing material, each said layer separated at most by a thermal conductor, and each said layer having a higher phase transition temperature than an adjacent outer layer whereby heat is transferred to charge the outer layer from the inner layer to reduce thermal impedence of said apparatus.

2. A system for storing and using heat, comprising:

an intermittent user having a maximum operating temperature and having a plurality of operating periods separated by idle periods, a first latent heat storing material having a phase transition temperature to a crystalline phase above the maximum operating temperature of the user and having short thermal paths to a heat transfer fluid which heat transfer fluid is in a heat exchange relationship with the user during the operating periods, a second latent heat storing material having a substantially larger thermal capacity, a substantially larger thermal energy density, and a higher phase transition temperature than the first latent heat storing material, and means for exchanging heat between the first and the second latent heat storing materials whereby the first latent heat storing material is recharged by discharging the second latent heat storing material.

* * * * *